US012629742B2

(12) United States Patent
Golding

(10) Patent No.: US 12,629,742 B2
(45) Date of Patent: May 19, 2026

(54) DIE ASSEMBLY AND METHOD OF MANUFACTURING A CONTAINER BODY

(71) Applicant: Crown Packaging Technology, Inc., Tinley Park, IL (US)

(72) Inventor: Richard Mark Orlando Golding, Mt Prospect, IL (US)

(73) Assignee: Crown Packaging Technology, Inc., Tinley Park, IL (US)

( * ) Notice: Subject to any disclaimer, the term of this patent is extended or adjusted under 35 U.S.C. 154(b) by 339 days.

(21) Appl. No.: 18/087,172

(22) Filed: Dec. 22, 2022

(65) Prior Publication Data

US 2024/0207918 A1 Jun. 27, 2024

(51) Int. Cl.

| | |
|---|---|
| ***B21D 22/28*** | (2006.01) |
| ***B21D 37/10*** | (2006.01) |
| ***B21D 51/26*** | (2006.01) |

(52) U.S. Cl.

CPC ..... *B21D 22/28* (2013.01); *B21D 37/10* (2013.01); *B21D 51/26* (2013.01)

(58) Field of Classification Search

CPC ..... B21D 22/28; B21D 22/283; B21D 37/10; B21D 51/26

See application file for complete search history.

(56) References Cited

U.S. PATENT DOCUMENTS

| | | | | |
|---|---|---|---|---|
| 3,656,335 A | | 4/1972 | Kaminski | |
| 3,826,123 A | | 7/1974 | Hasselbeck | |
| 3,943,740 A | | 3/1976 | Bartenstein | |
| 4,173,882 A | | 11/1979 | Lee, Jr. | |
| 4,262,512 A | * | 4/1981 | Maeder | B21D 45/065 72/349 |
| 4,300,375 A | * | 11/1981 | Maeder | B21D 22/286 72/349 |
| 4,554,815 A | | 11/1985 | Weishalla | |
| 4,926,669 A | | 5/1990 | Grims et al. | |
| 5,016,462 A | * | 5/1991 | Grims | B21D 22/283 72/349 |
| 5,740,692 A | | 4/1998 | Dunwoody | |

FOREIGN PATENT DOCUMENTS

| | | | |
|---|---|---|---|
| DE | 2915256 | A1 | 2/1980 |
| EP | 0005084 | A1 | 10/1979 |
| EP | 2943299 | B1 | 7/2017 |
| GB | 724251 | A | 2/1955 |
| GB | 2292707 | A | 3/1996 |
| GB | 2301055 | A | 11/1996 |
| WO | 2018/183090 | A1 | 10/2018 |

* cited by examiner

*Primary Examiner* — Debra M Sullivan

(74) *Attorney, Agent, or Firm* — Condo Roccia Koptiw LLP

(57) ABSTRACT

A die assembly comprising: a housing; a die for drawing and/or wall ironing a metal cup mounted on an end of a ram to form a container body; and a support mechanism for the die or a die holder in which the die is mounted. The support mechanism is configured to allow the die to tilt relative to the housing to reduce misalignment of a longitudinal axis of the die with respect to the ram during drawing and/or wall ironing of a metal cup. The die assembly further comprises a chamber provided in the housing and adapted for sealing fluid therein. The chamber is sealed by one or more surfaces coupled to or provided on the die or die holder such that tilting of the die during drawing and/or wall ironing of a metal cup moves the one or more or more surfaces against fluid sealed in the chamber.

16 Claims, 3 Drawing Sheets

DIE ASSEMBLY AND METHOD OF MANUFACTURING A CONTAINER BODY

TECHNICAL FIELD

The present invention relates to manufacturing container bodies, in particular but not exclusively, can bodies, e.g. beverage can bodies.

BACKGROUND

In known can bodymakers for the production of thin-walled metal two-piece can bodies by a "drawing and wall-ironing" (DWI) process, metal cups are fed to the bodymaker and carried by a punch on the end of a ram through a series of dies to produce a can body of the desired size and thickness. The series of dies may include a redraw die for reducing the diameter of the cup and lengthening its sidewall, and one or more ironing dies for wall-ironing the cup into a can body. The area or cradle of the bodymaker frame within which the dies are located is known as the "toolpack". The can body carried on the punch may ultimately contact a bottom forming tool or "domer" so as to form a shape such as a dome on the base of the can. An exemplary bodymaker is described in WO9934942.

Traditionally, alignment and re-alignment of bodymakers is a complex and time-consuming process that needs to be carried out laboriously by skilled operators (who are often in short supply) only after serious problems have developed. When setting up a can bodymaker, the ram and its drive components are typically fixed in place on the bodymaker frame. This aligns the axis of the ram with the main axis of the bodymaker. The other components, including for example the redraw and ironing dies and domer, are then aligned with the ram.

Can bodymakers are typically operated for extended periods at high speed to produce more than around 300 to 400 can bodies per minute. However, the quality of the can bodies that are produced can vary significantly over time because of changes in, for example: the alignment of the machine components, coolant temperature and flow rate, lubrication of the machine, and/or the quality of the incoming cups (e.g. because of variations in the quality of the metal coil from which the cups are made). Even small foreign bodies, such as dirt, between the dies may be sufficient to cause poor alignment. In some cases, wear of the dies may limit their working life to only a few days or less, particularly if there is imperfect alignment of the dies with respect to the ram, which may be problematic as precision machine components such as dies are costly and time consuming to manufacture.

Misalignments of the dies with respect to the ram may be corrected in some cases by inserting a shim, typically a thin piece of metal foil, behind one or more of the dies in the toolpack. However, such an approach relies on the experience and judgement of operators to select the right thickness and placement of shim and there may be considerable variability between operators.

Poor quality can bodies may lead to wastage and downtime in can production. This may occur, for example, either because the bodymaker itself must be re-aligned or repaired or because other machines further down the production line are adversely affected by the poor quality cans being produced. Unfortunately, the high speed, high volume nature of the can production industry means that lost production time can be very costly for producers.

EP0005084 describes the use of springs to accommodate radial movement of a die with respect to a ram. GB2301055 describes a redraw die having a spherical bearing surface mounted in a die holder having an arcuate surface that co-operates with the spherical bearing surface to allow a redraw sleeve in contact with a front face of the redraw die to re-orient the redraw die.

SUMMARY OF THE INVENTION

According to a first aspect of the present invention there is provided a die assembly comprising: a housing; a die for drawing and/or wall ironing a metal cup mounted on an end of a ram to form a container body; and a support mechanism for the die or a die holder in which the die is mounted. The support mechanism is configured to allow the die or die holder to tilt relative to the housing to reduce misalignment of a longitudinal axis of the die with respect to the ram during drawing or wall ironing of a metal cup. The die assembly further comprises a chamber provided in the housing and adapted for sealing fluid therein. The chamber is sealed by one or more surfaces coupled to or provided on the die or die holder such that tilting of the die during drawing and/or wall ironing of a metal cup moves the one or more or more surfaces against fluid sealed in the chamber.

Movement of the one or more surfaces may cause the fluid to be redistributed in the chamber in response to the tilting of the die or die holder. The fluid may provide resistance to movement of the die whilst still allowing the die to be tilted by the ram, thereby allowing misalignment of the longitudinal axis of the die with respect to the ram to be reduced.

In use, the chamber is filled with a fluid, e.g. a hydraulic fluid and/or pneumatic fluid. For example, the chamber may be filled with a hydraulic fluid, such as mineral oil or water. Alternatively or additionally, the chamber may be filled with a compressed gas, such as air or nitrogen. Typically, a high pressure of gas is used, e.g. more than 5 bar, or more than 10 bar, e.g. around 13.8 bar (200 psi). In some cases, the hydraulic fluid may solidify when the die assembly is not in use. For example, a solid wax or grease that liquefies when the die assembly is in use may be used, e.g. as a result of the heat generated by metal cups being driven through the die by the ram. In some implementations, the die assembly may comprise a cooling circuit comprising an inlet for connection to a coolant supply and an outlet through which to expel received coolant from the die assembly, with the cooling circuit being in heat exchange relationship with the die assembly. The melting point of the hydraulic fluid may be chosen to be below the temperature of the coolant, e.g. the melting point may be from 40 to 50° C. in some cases.

Preferably, the chamber is filled with hydraulic fluid completely (i.e. such that any residual gas in the chamber is minimised) to limit compressibility. Hydraulic fluid may also be preferred (compared to compressed gas) as there is may be no internal pressure (which would need to be contained) when the die assembly is not subject to any load.

The longitudinal axis of the die may be defined with respect to a front face of the die (e.g. the longitudinal axis may extend in a direction that is perpendicular to the front face of the die), or with respect to the passage (bore) through the die through which the metal cup travels (e.g. the longitudinal axis may extend in a direction that is parallel to the passage). Tilting of the die may refer to a change in the angle between the longitudinal axis of the die and an axis defined by the ram (e.g. an axis along which the ram moves or reciprocates). In general, the die may tilt in any direction to re-orient its longitudinal axis, e.g. about a vertical or horizontal direction, or some combination of vertical and horizontal directions. Thus, tilting the die may vary a pitch and/or yaw of the die with respect to the ram. Tilting of the die may also be referred to as pivoting or swivelling of the die. The die may also be referred to as being a "floating" die in some cases. In some implementations, the die assembly may be configured such that the die is able to tilt by greater than 0.01 degrees, greater than 0.03 degrees, greater than 0.05 degrees, or even greater than 0.1 or 0.2 degrees during drawing and/or wall ironing. The ability of the die to tilt by these amounts may mean that the die (and/or other parts used in the drawing and/or wall ironing process) can be manufactured with a lower level of precision than would otherwise be needed.

In general, drawing and/or wall ironing a metal cup comprises passing the metal cup through a die to increase a height of a sidewall of the metal cup (defined with respect to a base of the metal cup) and to simultaneously reduce the thickness of the sidewall.

In some implementations, the chamber extends between the housing and the die or die holder. The support mechanism may comprise first and second sealing elements forming respective seals between the housing and the die or die holder. The one or more surfaces movable against the fluid may, in some examples, be provided on the die or die holder so as to form a wall of the chamber.

Each sealing element may, for example, be an O-ring fitted between the die or die holder and the housing. Each sealing element is preferably elastomeric. In some implementations, the sealing elements may be configured such that the die is brought into alignment with the ram over a plurality of strokes of the ram, i.e. the die may not return to the same location with respect to the housing following displacement (i.e. deflection) and/or tilting of the die by the ram. The sealing elements are preferably configured such that the integrity of the seals is maintained as the die is tilted, i.e. the fluid remains trapped in the chamber.

In general, as the metal cup is forced through the die by the ram, small misalignments between the die and the ram lead to unbalanced forces acting on the die, which cause the die to move relative to the housing (these movements typically being very small in magnitude). The fluid provides resistance to inhibit or restrict the movement of the die within the housing, such that the sealing elements, housing and/or the die are not damaged by the impact of the ram. Preferably, hydraulic fluid that is substantially incompressible is used to minimise movement of the die, e.g. displacement along the longitudinal axis. Where a pneumatic fluid is used (e.g. compressed gas), the pressure may be selected to ensure that displacement of the die along the direction of the ram is limited to less than a predetermined distance.

As an example, when the die is a redraw die then, when the longitudinal axis of the die is misaligned with respect to the ram (i.e. misaligned with respect to the direction along which the ram is moving as it enters the die), a front face of the die may be tilted by a small extent, such that a portion of the front face is tilted towards the approaching metal cup. This portion is contacted by the metal cup slightly in advance of another portion of the front face of the ram that is tilted away from the metal cup. The contact with the metal cup may therefore cause the front face of the die to be re-oriented so that it is parallel to the base of the metal cup mounted on the ram (and the longitudinal axis of the die may therefore be brought into better alignment with the ram). Thus, the combined actions of the contact force applied to the front face of the die by the metal cup and the reaction force from the fluid acting on the corresponding back face of the die may improve the alignment of the die dynamically during the redraw process. The need for static adjustments to be made by operators of the machine may therefore be avoided or minimised. When the die is an ironing die, the forces on the die exerted by the metal cup as it passes through the central hole or passage (bore) of the die are unbalanced such that the die is brought into coaxial alignment with the metal cup (and the ram).

In some implementations, the chamber may extend between a face of the die or die holder extending transverse to the longitudinal axis and a corresponding face of the housing extending transverse to the longitudinal axis. The face of the die or die holder and the face of the housing may be substantially planar and parallel to one another, for example. Such a configuration may allow the die or die holder to move in a direction parallel to the ram. The chamber may also have a larger cross sectional area in such a configuration. For example the face of the die or die holder may be in contact with the fluid over a majority (e.g. substantially all) of its surface area. The forces exerted on the fluid by the die or die holder may therefore be spread over a larger area compared to a chamber having a smaller cross sectional area, which allows the die to be re-orientated more easily (i.e. with less force from the ram being required).

Alternatively or additionally, the chamber may extend between a first surface (e.g. an annular surface) of the die or die holder extending around the longitudinal axis and a corresponding first surface (e.g. annular surface) of the housing extending around the longitudinal axis. The chamber may therefore accommodate movement of the die or die holder in a direction transverse to the longitudinal axis, i.e. perpendicular to the ram. The first sealing element may comprise a sealing ring (e.g. an O-ring) provided between the first surface of the die or die holder and the first surface of the housing. The first surface of the die or die holder may be tapered along a direction parallel to the longitudinal axis, which may facilitate installation of a sealing ring onto the die or die holder. Preferably, the first surface of the die or die holder and the first surface of the housing form respective sidewalls of the chamber (i.e. walls of the chamber extending substantially along the longitudinal axis).

The chamber may also extend between a second surface of the die or die holder (i.e. a surface different from the first surface of the die or die holder, e.g. an annular surface) extending around the longitudinal axis and a corresponding second surface (e.g. annular surface) of the housing extending around the longitudinal axis. The second sealing element may comprise a sealing ring (e.g. an O-ring) provided between the second surface of the die and the second surface of the housing. Thus, the die or die holder may be supported radially between the first and second sealing rings, with the fluid being confined in the chamber by the sealing rings. Such a configuration may provide the die or die holder with sufficient freedom of movement to adjust its alignment and/or position to that of the ram during drawing and/or wall ironing. Preferably, the second surface of the die or die holder and the second surface of the housing form respective sidewalls of the chamber. The second surface may be provided on a portion of the housing that extends (axially, i.e. along a direction parallel to the longitudinal axis of the die) into a recess of the die or die holder (e.g. an annular recess). The recess may be provided, for example, in the form of a ring-shaped channel extending into the die or die holder and may adjoin (e.g. open into) a passage of the die or die holder through which the metal cup is passed during the drawing and/or wall ironing.

In general, each sealing ring conforms to the surface on which it is provided, which may be of any shape (i.e. cross section), such as circular or ellipsoidal (e.g. round), square or rectangular, X-shaped or double X-shaped, a polygon with rounded corners and so forth. In some implementations, one or more (e.g. all) of the sealing rings may be elastomeric.

In some implementations, the die may be nested within the die holder. "Nested" in this context refers to radial nesting, such that the outer perimeter of the die is surrounded by an inner perimeter of the die holder. The die holder and die define a passage through which the metal cup is passed during the drawing and/or wall ironing. The die holder may be supported by the first and second sealing elements, with the die being supported by the die holder. The die may be removable from the die holder to facilitate replacement and/or maintenance of the die, e.g. following damage or wear of the inner perimeter of the die. Another die (e.g. one having a different internal diameter and/or internal profile) may then be installed in the die holder. The die assembly may be provided (e.g. sold) as part of a kit, with more than one such die in some cases. Similarly, in other cases, the die assembly may be provided with a die holder installed, but no die.

In some implementations, the support mechanism is configured to allow deflection of the die or die holder transverse to the longitudinal axis during the drawing or wall ironing. For example, the die or die holder may be mounted in an elastomeric ring (e.g. O-ring) that allows deflection of the die or die holder transverse to the longitudinal axis during the drawing or wall ironing. Such movement may compensate for misalignments between the die and the ram (e.g. axial misalignments such that the longitudinal axis is offset relative to the ram) in addition to the misalignments that can be corrected by tilting the die.

In some implementations, the housing may comprise a sealable inlet (e.g. a threaded hole) through which to supply fluid to the chamber. Of course, more than one sealable inlet may be used (e.g. 2, 3 or more). In other implementations, the fluid may be sealed in the chamber during manufacture of the die assembly. Thus, the die assembly may be installed in a toolpack of a can bodymaker (for example) without an operator of the can bodymaker needing to fill the chamber with fluid.

Preferably, the die assembly (in particular, the die) is for forming one or more of: beverage cans (e.g. two-piece cans), food cans, paint cans, aerosol cans and the like.

Optionally, the die is an ironing die (i.e. a die suitable for wall ironing) or a redraw die (i.e. a die suitable for drawing/redrawing). The redraw die may be configured such that a metal cup may be clamped between a redraw sleeve and a front face of the die during redrawing, for example.

According to a second aspect of the present invention there is provided a can bodymaker comprising one or more die assemblies according to the first aspect. For example, the can bodymaker may comprise a die assembly according to the first aspect in which the die is a redraw die (i.e. a die suitable for drawing/redrawing) and one or more other die assemblies according to the first aspect in which the die is an ironing die (i.e. a die suitable for wall ironing). In implementations, the ironing die(s) may have a smaller internal diameter than the redraw die.

According to a third aspect of the present invention there is provided a method of manufacturing a container body from a metal cup using one or more die assemblies according to the first aspect. The method comprises using a ram to force the metal cup through the die of each of the one or more die assemblies. The metal cup may therefore be drawn and/or wall ironed to have a desired height and sidewall thickness. The method may comprise adjusting a pressure of fluid in the chamber to control the amount by which the die is able to tilt during drawing and/or wall ironing of the metal cup. For example, the pressure may be adjusted depending on the diameter of the container being fabricated.

In some implementations, during drawing (redrawing) of the metal cup, the load on the die along the direction of the ram may, for example, be in a range from about 20 kN to about 25 KN. Ironing loads may be in a range from about 3 kN to about 10 kN (preferably from 7 kN to 9 kN). The die assembly may be configured such that the hydraulic fluid and/or pneumatic fluid is able to provide an equal but opposite reaction force to counteract the load from the ram. In particular, fluid may be selected to provide a reaction force such that the die moves in the direction of the ram by less than a predetermined distance under the load from the ram (e.g. by less than 10 microns).

In some implementations, the die assembly comprises one or more pistons, each piston providing a respective one of the one or more surfaces sealing the chamber. The pistons may be arranged such that tilting of the die or die holder causes at least one of the one or more pistons to move against fluid sealed in the chamber. In some implementations where the die assembly comprises a plurality of pistons, the one or more pistons may be arranged such that movement of one or more pistons against fluid sealed in the chamber causes the fluid to move one or more others of the pistons against the die or die holder. For example, tilting of the die or die holder may cause the one or more pistons to move in a direction parallel to the ram, whilst redistribution of the fluid in the chamber may cause the one or more others of the pistons to move in the opposite direction to aid in tilting the die or die holder. In some examples, each piston may move within a respective channel forming part of the chamber. Preferably each channel and the corresponding piston are arranged (substantially) parallel to the ram. The pistons may be arranged such that tilting of the die or die holder causes at least one of the pistons to move along its respective channel in the direction of the ram.

The pistons may be angularly spaced apart around the longitudinal axis of the die, for example. Preferably, there are three or more pistons to allow the die to be tilted along two orthogonal axes.

According to a fourth aspect of the present invention, there is provided a die assembly comprising: a housing; a die for drawing and/or wall ironing a metal cup mounted on an end of a ram to form a container body; and a support mechanism for the die and configured to allow the die to tilt relative to the housing. One or more channels may be provided in the housing and adapted for sealing fluid therein. Each channel may comprise a respective piston coupled to the die and a respective adjustment mechanism for applying pressure to fluid in the channel to move the piston and cause the die to tilt relative to the housing. Misalignment of a longitudinal axis of the die with respect to the ram may therefore be reduced using the or each adjustment mechanism.

The pistons may be angularly spaced apart around the longitudinal axis of the die, for example (e.g. where there are three pistons they may be spaced apart by 120 degrees, although the spacing does not have to be uniform). Preferably, there are three or more pistons to allow the die to be tilted along two orthogonal axes.

Each adjustment mechanism may, for example, comprise a threaded member (e.g. bolt) engaged in a threaded opening into the channel, wherein screwing the threaded member into (out of) the threaded opening decreases (increases) the volume of the channel to vary the force on the corresponding piston and thereby tilt the die. The die may optionally be provided in a die holder, with the pistons acting on the die holder, for example.

Optionally, each adjustment mechanism may be computer controlled (e.g. via a wired or wireless connection) such that misalignment of the longitudinal axis of the die with respect to the ram can be reduced whilst the die assembly is in use.

In some implementations, the die assembly may comprise one or more sensors configurable or configured to provide respective signals indicative of misalignment of the longitudinal axis of the die with respect to the ram. In general, many different types of sensor may be used. For example, one or more (e.g. each) of the channels may comprise a respective pressure sensor for measuring the pressure exerted on fluid in the channel by the corresponding piston during the drawing and/or wall ironing process. Alternatively or additionally, the sensors may comprise one or more force sensors (e.g. load cells), each force sensor being oriented to measure a force on the die at a respective position about the longitudinal axis of the die, e.g. the force sensors may be provided between respective faces of the housing and the die.

The signal(s) may be provided to a computer device that controls each adjustment mechanism, which adjusts one or more (e.g. each) of the adjustment mechanisms based on the signal(s) to reduce the misalignment. The computer device may execute a feedback control loop such that the adjustments maintain a correct or desired alignment of the die, e.g. in spite of varying operating conditions such as temperature changes, wear to the die and so on. For example, a proportional-integral-derivative (PID) controller can be used to adjust each of the adjustment mechanisms to minimise an error signal determined from the sensor signals. The error signal may, for example, be a measure of differences (or ratios) between the sensor signals.

Alternatively or additionally, the signal(s) provided by the sensor(s) may be displayed visually (e.g. on a graphical user interface) or otherwise communicated to a user, who may then use one or more of the adjustment mechanisms to reduce the misalignment.

According to a fifth aspect of the present invention there is provided a method of aligning a machine (e.g. a can bodymaker) for manufacturing a container body from a metal cup. The machine comprises one or more die assemblies according to the fourth aspect. The method comprises using one or more of the adjustment mechanisms to apply pressure to fluid in the chamber to move the corresponding piston(s) and cause the die to tilt relative to the housing.

In each of the above aspects, the die assembly may comprise one or more additional dies that are coupled to the die such that tilting of the die causes the additional die(s) to tilt as well. For example, the die and the additional die(s) may be fixed to one another such that they move/tilt as a single unit. The additional die(s) are preferably located closer to the entrance of the toolpack than the die.

DETAILED DESCRIPTION

Figure 1:
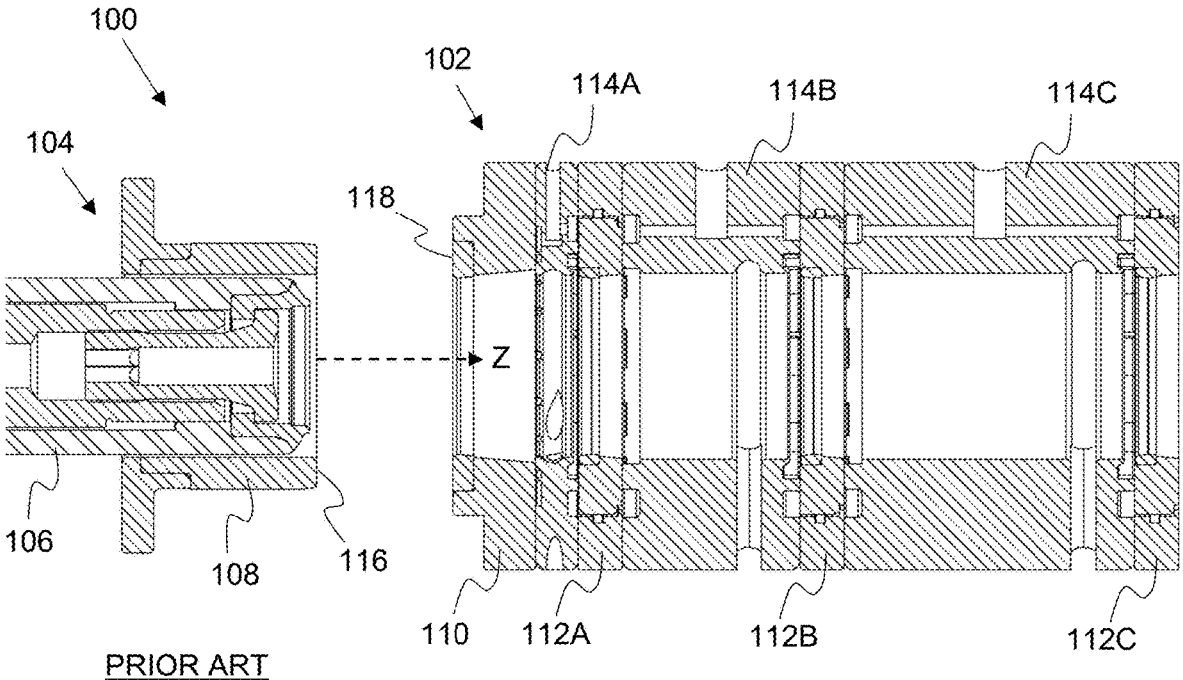
PRIOR ART Figure 1
FIG. 1 is a schematic vertical cross section view of a ram, redraw sleeve and toolpack of a can bodymaker according to the prior art.

FIG. 1 shows parts of a can bodymaker 100 comprising a toolpack 102, a ram 106 and a redraw sleeve 108. The toolpack 102 comprises a redraw die 110 and a plurality of ironing dies 112A-C arranged one after another along an axis Z, with intervening spacer rings 114A-C provided between the dies. The dies and the spacer rings each have a respective bore or passage, which are aligned about the axis Z to provide a passage extending through the toolpack 102 through which the ram 106 is able to reciprocate.

In operation, the ram 106 drives a metal cup (not shown) through the dies 110, 112A-C to draw and wall iron the metal cup to form a can body. Before entering the dies, the metal cup is mounted on the redraw sleeve 108, with the redraw sleeve 108 being received by the metal cup such that a sidewall of the metal cup extends around the circumference of the redraw sleeve 108 and a front face 116 of the redraw sleeve 108 and the ram 106 contacts a base of the metal cup (the front part of the ram 106 may be referred to as a punch). The ram 106 and redraw sleeve 108 drive the base of the metal cup against a front face 118 of the redraw die 110 (i.e. a face of the redraw die 110 that is directed towards the ram 106), such that the base of the metal cup is clamped between the redraw sleeve 108 and the front face 118 of the redraw die 110. The forwards motion of the redraw sleeve 108 is interrupted by the toolpack 102, whilst the ram 106 continues through the redraw sleeve 108 to force the base of the metal cup through the redraw die 110, thereby "drawing" the metal cup from between the faces 116, 118 of the redraw sleeve 108 and the redraw die 110, thus reducing the diameter and elongating the sidewall of the metal cup. The ram 106 continues to force the metal cup through the passage defined by the ironing dies 112A-C and the other toolpack components. The later ironing dies 112B, C have successively smaller internal diameters so that the sidewall of the metal cup is further elongated and made thinner as the metal cup passes through the toolpack 102.

Figure 2:
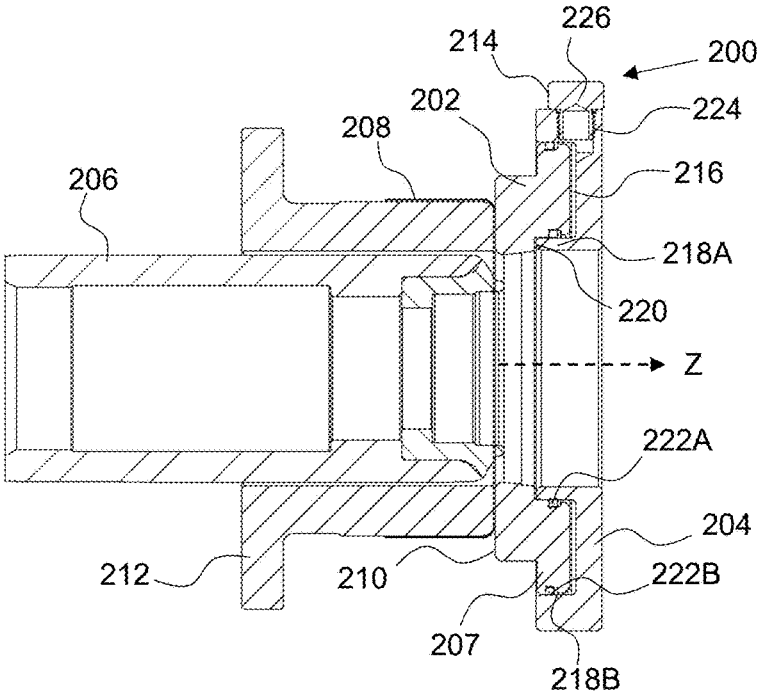
FIG. 2 is a schematic vertical cross section view of a ram, redraw sleeve and a redraw die assembly according to an embodiment of the present invention.

FIG. 2 shows a die assembly 200 which comprises a redraw die 202 and a housing 204. The redraw die 202 is generally ring-shaped with an internal diameter that is chosen to allow a ram 206 to pass through the redraw die 202. Only a small amount of radial clearance is provided between the ram 206 and the redraw die 202 to (partially) accommodate the thickness of the sidewall of a metal cup 208 during the drawing process. The redraw die 202 has a front face 210 against which the base of the metal cup 208 is clamped by a redraw sleeve 212 at the start of the drawing process. The redraw die 202 has a flanged portion 207 that is spaced apart from the front face 210 and which has a larger external diameter than the front face 210 of the redraw die 202. The flanged portion 207 of the redraw die 202 is received by a corresponding channel formed in a front face 214 of the housing 204. The flanged portion 207 of the redraw die 202 is spaced apart (inwardly) from the housing 204 so as to define a chamber 216 between the housing 204 and the redraw die 202.

In use, the chamber 216 is filled with hydraulic fluid, such as mineral oil, although other fluids, such as compressed air (or other pneumatic gases) can be used instead or in addition to the hydraulic fluid. Preferably, however, the chamber 216 is filled completely with hydraulic fluid to ensure uniformity and reduce compressibility.

The housing 204 comprises a cylindrical inner sidewall 218A that is located radially inwards of the flanged portion 207 of the redraw die 202 and which abuts a lip 220 formed on the interior surface of the redraw die 202. An O-ring 222A is provided between the inner sidewall 218 of the housing 204 and the flanged portion 207 of the redraw die 204, with the O-ring encircling the inner sidewall 218 of the housing 204. In the present example, the O-ring 222A is seated in a circumferential groove in the flanged portion 207 of the redraw die 204. However, the O-ring 222A may alternatively or additionally be seated in a groove formed in the inner sidewall 218 of the housing 204. A second O-ring 222B is provided between a cylindrical outer sidewall 218B located radially outside the flanged portion 207 of the redraw die 202. In the present example, the O-ring 222B is seated in a circumferential groove formed around the flanged portion 207 of the redraw die 202, but as with the first O-ring 222A, the second O-ring 222B may be additionally or alternatively located in a groove formed in the outer sidewall 218B of the housing 204. Preferably, both O-rings 222A, B are seated in grooves on the redraw die 202 so that the redraw die 202 can be removed from and replaced into the housing 204 easily, e.g. to facilitate replacement of the redraw die 202 after it has become worn or damaged.

The two O-rings 222A, B seal the chamber 216 to prevent the hydraulic fluid from leaking from the chamber 216 as a result of the substantial forces on the die assembly 200 produced by the metal cup 208, the ram 206 and the redraw sleeve 212 during the drawing process.

In the present example, the O-rings 222A, B are made from an elastomeric material, e.g. Nitrile Butadiene Rubber (NBR), such that the redraw die 202 can be deflected within the housing 204 by a small amount without allowing the hydraulic fluid to leak from the chamber 216. In particular, the O-rings 222A,B can be deformed by the redraw die 202 to allow the redraw die 202 to tilt as the metal cup 208 and the redraw sleeve 212 contact the front face 210 of the redraw die 202. The die assembly 200 therefore allows the redraw die 204 to be re-oriented dynamically following contact with the metal cup, such that the front face 210 of the redraw die 202 is brought into parallel alignment with a front face of the redraw sleeve 212 during the drawing process. Such an alignment allows an even clamping pressure to be applied to the metal cup 208 during the drawing process, which may lessen or avoid defects (e.g. wrinkles or "witness lines") being formed in the sidewall of the metal cup 208 as it is drawn through the redraw die 202 by the ram 206.

The housing 204 may comprise an inlet 224 that extends through the outer sidewall 218B through which to introduce the hydraulic fluid into the chamber 216. In the present example, the inlet 224 is threaded such that the inlet 224 can be sealed with, for example, a bolt 226 screwed into the inlet 224. Thus, the die assembly 200 may be used, at least in some cases, without needing to be attached to any external pressure source.

Figure 3:
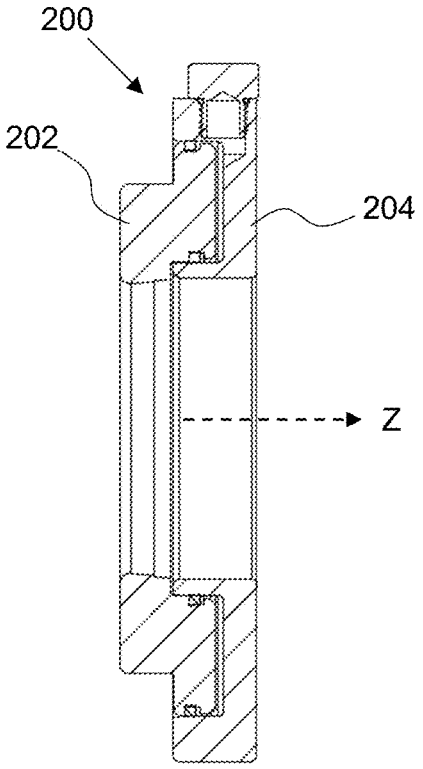
FIG. 3 is a schematic vertical cross section view of the redraw die assembly shown in FIG. 2.

FIG. 3 shows an enlarged view of the die assembly 200 separately from the other parts of the can bodymaker.

Figure 4:
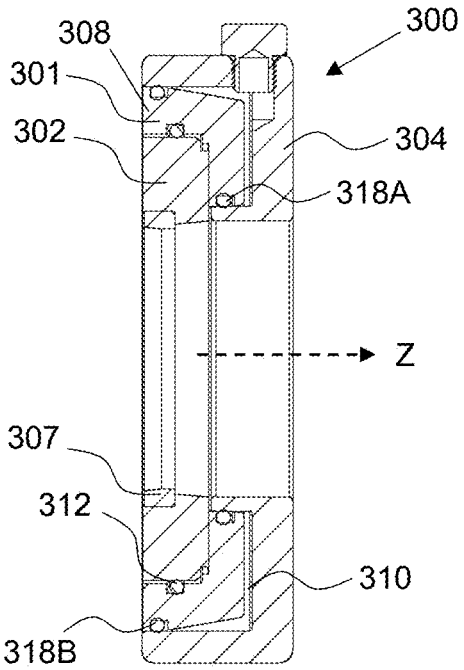
FIG. 4 is a schematic vertical cross section view of an ironing die assembly according to an embodiment of the present invention.

FIG. 4 shows a die assembly 300 that is similar to the die assembly 200 of FIGS. 2 and 3, except the die assembly 300 comprises die holder 301 in which an ironing die 302 (rather than a redraw die 202) is mounted. The housing 304 of the die assembly 300 also encloses the die holder 301 and ironing die 302 along their length (i.e. parallel to the longitudinal axis Z of the ironing die 302), such that the die holder 301 and the ironing die 302 remain able to tilt (i.e. be re-oriented with respect to the housing 304 and the ram) once the die assembly 300 has been installed into the toolpack of the can bodymaker. In some implementations, the ironing die 307 may be removable from the die assembly 300.

In the present example, the ironing die 302 comprises an ironing ring 307 through which the metal cup is forced by the ram to "wall iron" (i.e. lengthen and thin) the sidewall of the metal cup 208 after it has been drawn through the redraw die 202.

The die holder 301 is received into the housing 304 in a similar manner to the redraw die 202 and the housing 204 shown in FIGS. 2 and 3. Thus, a chamber 310 is provided between the housing 304 and the support ring 308, which is filled with hydraulic fluid (at least when the die assembly 300 is in use). The chamber 310 is sealed by two O-rings 318A, B located between corresponding annular surfaces of the support ring 308 and the housing 304. The O-rings permit the support ring 308 to be re-oriented during the ironing process, as described above with respect to the redraw die 202.

The die 302 is radially nested within the die holder 301 within an O-ring 312. In some examples, the O-ring 312 may permit the die 302 to be deflected by a small amount within the die holder 301, e.g. translated radially within the die holder 301, so that the die 302 is concentrically aligned with the ram 206. Thus, the die 300 assembly may allow both concentric and coaxial alignment of the die 302 with the ram 206.

Figure 5:
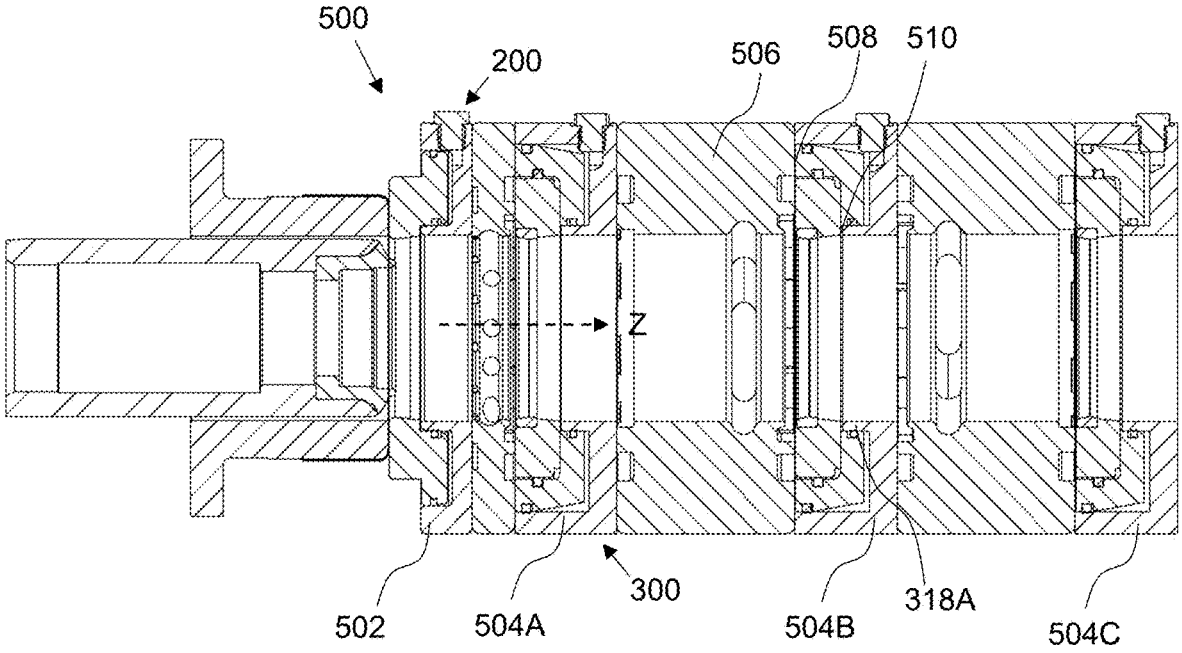
FIG. 5 is a schematic vertical cross section view of a toolpack of a can bodymaker according to an embodiment of the present invention.

FIG. 5 shows a toolpack of a can bodymaker 500 comprising a redraw die assembly 502, which may be the redraw die assembly 200 as described above in connection with FIGS. 2 and 3, and a plurality of ironing die assemblies 504A-C, which may each be an ironing die assembly 300 as described above in connection with FIG. 4.

Figure 6:
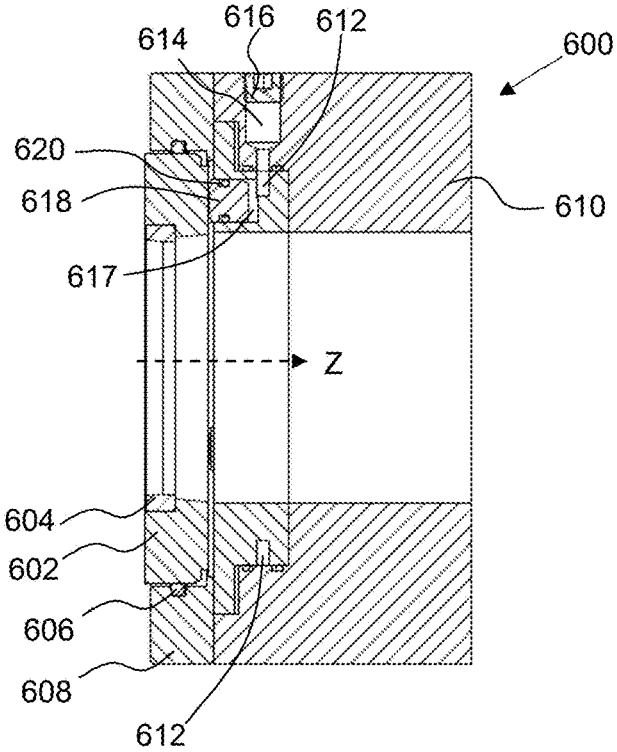
FIG. 6 is a schematic vertical cross section view of a die assembly according to an embodiment of the present invention.

FIG. 6 shows a die assembly 600 comprising a die 602 with an ironing ring 604 supported by a sealing ring 606 extending around an outer perimeter of the die 602 and extending partially into a channel formed on an interior surface of a mounting ring 608. The sealing ring 606 is elastomeric to allow the die 602 to tilt within the mounting ring 608 during drawing and/or wall ironing. The die assembly 600 further includes a housing 610 comprising a chamber 612 that extends around the longitudinal axis Z of the die (e.g. the chamber 612 may be substantially cylindrical). In use, the chamber 612 is filled with hydraulic fluid introduced into the chamber 612 through an inlet 614 extending through the housing 610, the inlet 614 subsequently being sealed with a stopper 616 (such as a bolt). The chamber 612 comprises a plurality of channels 617 extending towards the die 602, each channel being sealed with a respective piston 618 configured to slide within the channel 617 in a direction parallel to the longitudinal axis Z of the die 602), with fluid being prevented from leaking from the channel 617 by a sealing ring 620 between the piston 618 and a sidewall of the channel. Each of the channels 617 is in fluid communication with the other channels via the chamber 612.

In the cross section of FIG. 6, only one such channel 617 and piston 618 are visible, but the chamber 612 includes two further channels and pistons that are angularly spaced apart from the channel and piston 618 around the longitudinal axis Z. When the die 602 is tilted during drawing and/or wall ironing of a metal cup, the die 602 contacts the piston 618, causing it to move along the channel 617 to exert pressure on the fluid in the chamber 612. This pressure is transmitted by the fluid in the chamber 612 to the other pistons 618 causing them to move outwards (i.e. in a direction opposite to the Z direction). Thus, the longitudinal positions of the pistons 618 in their respective channels 617 adjusts in response to the tilting of the die 602.

In an alternative implementation of the die assembly 600, each of the pistons 618 and the channels 617 are not in fluid communication with one another, i.e. each channel 617 is isolated from the other channels 617, and each channel 617 has a separate inlet 614 through which to supply fluid to it. Each channel 617 has an adjustment mechanism, which allows a force to be transmitted to each of the pistons 618 via the fluid. For example, each inlet 614 may have a stopper 616 (e.g. a threaded member, such as a bolt) that can be displaced (e.g. screwed) into the inlet 614 to exert a force on the fluid in the inlet 614. The resulting longitudinal movement of the piston 618 in response to the force causes the die 602 to tilt. One or more (e.g. each) of the adjustment mechanisms (e.g. stopper 616) may therefore be used to adjust the tilt of the die 602 to improve its alignment with the ram of the can bodymaker. For example, the adjustment mechanisms may be adjusted iteratively to improve the alignment. In contrast to the other implementations described above, once the tilt of the die 602 has been correctly aligned, the die 602 may remain in substantially that orientation when the can bodymaker is operated, i.e. the alignment is static, rather than dynamic, and may undergo minimal variation as the ram passes through the die 602.

In some examples, each stopper 616 is coupled to an actuator that controls the displacement of the stopper within the inlet 616, e.g. a linear actuator or, when a threaded stopper is used, a rotary actuator. Each actuator can be computer controlled (e.g. via a wired or wireless connection) to adjust the displacement of the corresponding piston in the channel 617. The die assembly 600 may comprise one or more sensors (not shown) configurable or configured to provide respective signals indicative of misalignment of the longitudinal axis of the die with respect to the ram. In general, many different types of sensor may be used. For example, the actuator may comprise a force sensor configured to measure the force transmitted to the actuator from the die 602 by the piston 618 and fluid during drawing and/or wall ironing of a metal cup.

The signal(s) may be provided to a computer device that controls the actuators, which then adjusts one or more (e.g. each) of the actuators based on the signal(s) to reduce the misalignment. The computer device may execute a feedback control loop such that the adjustments maintain a correct or desired alignment of the die, e.g. in spite of varying operating conditions such as temperature changes, wear to the die and so on. For example, a proportional-integral-derivative (PID) controller can be used to adjust each of the actuators to minimise an error signal determined from the sensor signals. The error signal may, for example, be a measure of differences (or ratios) between the sensor signals.

The die assemblies 200, 300, 600 may be used to forming container bodies of many different types and sizes, such as beverage cans (e.g. two-piece cans, sleek or standard can, a 53 mm or 66 mm diameter can etc.), food cans, paint cans, aerosol cans and the like. The metal cups from which the can bodies are produced may be made from (for example) sheet steel or aluminium, or an alloy containing either of these, and may be pre-coated (e.g. laminated) with an organic coating, such as a polyester. The redraw die assemblies 200, ironing die assemblies 300, and die assemblies 600 as described herein may be configured to fit in a toolpack of existing can bodymakers, such that they can be installed as replacements for existing die assemblies without the toolpack needing to be modified (or such that minimal modifications are required). Components of a bodymaker disclosed in WO9934942, entitled Press for Can Manufacture, which is incorporated herein by reference, may be employed for components of some embodiments of bodymaker 500.

Although the sealing elements of the above described embodiments are sealing rings (O-rings), other forms of sealing element may be used alternatively or in addition, such as a diaphragm or bellows arrangement. Alternatively or additionally, the fluid may be sealed in a flexible enclosure (e.g. bag or sack) housed within the chamber. In such cases different sections (e.g. opposing ends) of the enclosure may be identified as the sealing elements.

It will be appreciated by the person of skill in the art that various modifications may be made to the above described embodiments without departing from the scope of the Invention. In particular, whilst particular embodiments of the subject matter have been described, other embodiments are also within the scope of the following claims.

The invention claimed is:

1. A die assembly for a can bodymaker including a ram, the die assembly comprising:

a housing;

a die for drawing and/or wall ironing a metal cup mounted on an end of the ram to form a container body;

the die being configured to tilt relative to the housing to reduce misalignment of a longitudinal axis of the die with respect to the ram during drawing and/or wall ironing of the metal cup; and a chamber provided in the housing and adapted for sealing fluid therein, the chamber being sealed by one or more surfaces on the die or a die holder such that tilting of the die during drawing and/or wall ironing of the metal cup moves the one or more or more surfaces against fluid sealed in the chamber.

2. A die assembly according to claim 1, wherein the chamber extends between the housing and the die or the die holder, and a die support comprising of first and second sealing elements forming respective seals between the housing and the die or the die holder.

3. A die assembly according to claim 2, wherein the chamber extends between a face of the die or the die holder extending transverse to the longitudinal axis and a corresponding face of the housing extending transverse to the longitudinal axis.

4. A die assembly according to claim 2, wherein the one or more surfaces of the die or the die holder includes a first surface, and wherein the chamber extends between the first surface of the die or the die holder extending around the longitudinal axis and a corresponding first surface of the housing extending around the longitudinal axis.

5. A die assembly according to claim 4, wherein the one or more surfaces of the die or the die holder further includes a second surface, and wherein the chamber extends between the second surface of the die and the die holder extending around the longitudinal axis and a corresponding second surface of the housing extending around the longitudinal axis.

6. A die assembly according to claim 5, wherein the first and second surfaces of the die or the die holder are located between the corresponding first and second surfaces of the housing.

7. A die assembly according to claim 5, wherein the second sealing element comprises a sealing ring provided between the second surface of the die or the die holder and the second surface of the housing.

8. A die assembly according to claim 7, wherein the second surface is provided on a portion of the housing that extends into a recess of the die or the die holder.

9. A die assembly according to claim 4, wherein the first sealing element comprises a sealing ring provided between the first surface of the die or the die holder and the first surface of the housing.

10. A die assembly according to claim 9, wherein the first surface of the die or the die holder is tapered along a direction parallel to the longitudinal axis.

11. A die assembly according to claim 2, wherein the die support is configured to allow deflection of the die or the die holder transverse to the longitudinal axis during drawing or wall ironing of the metal cup.

12. A die assembly according to claim 1, wherein the housing comprises one or more sealable inlets through which to supply fluid to the chamber.

13. A die assembly according to claim 1, wherein the die assembly comprises one or more pistons, each piston providing a respective one of the one or more surfaces sealing the chamber, the one or more pistons being arranged such that tilting the die causes at least one of the one or more pistons to move against fluid sealed in the chamber.

14. A die assembly according to claim 13, wherein the one or more pistons is arranged such that movement of one or more pistons against fluid sealed in the chamber causes the fluid to move one or more others of the pistons against the die.

15. A can bodymaker comprising:

one or more die assemblies according to claim 1; and the ram adapted for moving the metal cup through the die.

16. A method of manufacturing a container body from a metal cup using one or more die assemblies according to claim 1, the method comprising using a ram to force the metal cup through the die of each of the one or more die assemblies.

* * * * *